US009021638B2

(12) United States Patent
Misaki

(10) Patent No.: US 9,021,638 B2
(45) Date of Patent: May 5, 2015

(54) MATTRESS

(71) Applicant: Tokai Rubber Industries, Ltd., Aichi (JP)

(72) Inventor: Akitsugu Misaki, Aichi (JP)

(73) Assignee: Sumitomo Riko Company Limited, Aichi (JP)

( * ) Notice: Subject to any disclaimer, the term of this patent is extended or adjusted under 35 U.S.C. 154(b) by 0 days.

(21) Appl. No.: 14/030,427

(22) Filed: Sep. 18, 2013

(65) Prior Publication Data

US 2014/0013514 A1 Jan. 16, 2014

Related U.S. Application Data

(63) Continuation of application No. PCT/JP2012/004817, filed on Jul. 27, 2012.

(30) Foreign Application Priority Data

Jul. 28, 2011 (JP) ..... 2011-165309

(51) Int. Cl.

| | |
|---|---|
| ***A47C 27/10*** | (2006.01) |
| ***A47C 27/08*** | (2006.01) |
| ***A61G 7/057*** | (2006.01) |

(52) U.S. Cl.

CPC ..... *A47C 27/082* (2013.01); *A61G 7/05776* (2013.01); *A61G 7/05769* (2013.01); *A47C 27/083* (2013.01); *A47C 27/10* (2013.01); *A61G 2203/34* (2013.01)

(58) Field of Classification Search

CPC .... A47C 27/081; A47C 27/087; A47C 27/10; A47C 27/082; A61G 7/05776; A47G 2009/003

USPC ..... 5/706, 644, 710–713, 655.3

See application file for complete search history.

(56) References Cited

U.S. PATENT DOCUMENTS

| | | | | |
|---|---|---|---|---|
| 3,753,819 | A * | 8/1973 | Mollura | 156/69 |
| 3,879,776 | A * | 4/1975 | Solen | 5/665 |
| 4,329,748 | A * | 5/1982 | Finkelstein | 5/683 |

(Continued)

FOREIGN PATENT DOCUMENTS

| | | |
|---|---|---|
| GB | 2110984 | 6/1983 |
| JP | 5-345005 | 12/1993 |

(Continued)

OTHER PUBLICATIONS

International Search Report, mail date is Aug. 28, 2012.

(Continued)

*Primary Examiner* — Nicholas Polito
*Assistant Examiner* — Eric Kurilla
(74) *Attorney, Agent, or Firm* — Greenblum & Bernstein, P.L.C.

(57) ABSTRACT

A mattress including a plurality of cells aligned and disposed on a body pressure working surface of a substrate that supports a human body; and a pressure control member that changes a height of each cell by adjusting a pressure in a fluid chamber formed within the cell. The cells are configured such that as the each cell is inflated by fluid supplied to the fluid chamber within the cell, the height of the each cell increases and a width dimension of the each cell in a direction of alignment decreases, and that peripheral portions of adjacent cells in the direction of alignment are overlapped with each other prior to cell inflation.

7 Claims, 8 Drawing Sheets

(56) References Cited

U.S. PATENT DOCUMENTS

| | | | | | |
|---|---|---|---|---|---|
| 4,982,466 | A * | 1/1991 | Higgins et al. | 5/713 |
| 5,109,560 | A * | 5/1992 | Uetake | 5/713 |
| 5,117,518 | A * | 6/1992 | Schild | 5/713 |
| 5,619,764 | A | 4/1997 | Lopau | |
| 5,727,270 | A * | 3/1998 | Cope et al. | 5/710 |
| 6,073,290 | A * | 6/2000 | Miller, Sr. | 5/710 |
| 6,073,291 | A | 6/2000 | Davis | |
| 6,200,403 | B1 * | 3/2001 | Thomas et al. | 156/242 |
| 6,302,988 | B1 * | 10/2001 | Miller, Sr. | 156/227 |
| 6,415,467 | B1 * | 7/2002 | Bretvin | 5/710 |
| 6,546,580 | B2 | 4/2003 | Shimada | |
| 6,691,355 | B1 * | 2/2004 | Liu | 5/714 |
| 6,775,868 | B1 * | 8/2004 | Mileti et al. | 5/710 |
| 7,587,776 | B2 * | 9/2009 | Poulos | 5/713 |
| 7,958,789 | B2 * | 6/2011 | Hayakawa et al. | 73/862.626 |
| 2003/0208849 | A1 * | 11/2003 | Wilkinson | 5/713 |
| 2004/0107503 | A1 * | 6/2004 | Tu | 5/710 |
| 2005/0097674 | A1 * | 5/2005 | Mileti | 5/710 |
| 2005/0204475 | A1 | 9/2005 | Schmitz et al. | |
| 2005/0229320 | A1 * | 10/2005 | Wu | 5/706 |
| 2007/0094806 | A1 * | 5/2007 | Beretta | 5/713 |
| 2010/0000020 | A1 * | 1/2010 | Poulos | 5/713 |
| 2010/0024123 | A1 * | 2/2010 | Davis | 5/81.1 R |
| 2010/0146709 | A1 * | 6/2010 | Lafleche et al. | 5/713 |
| 2010/0318239 | A1 * | 12/2010 | Oexman et al. | 700/301 |
| 2011/0203053 | A1 * | 8/2011 | Mulliez | 5/712 |
| 2011/0239373 | A1 * | 10/2011 | Miller, Jr. | 5/710 |
| 2011/0308019 | A1 * | 12/2011 | Terawaki et al. | 5/713 |

FOREIGN PATENT DOCUMENTS

| | | | | |
|---|---|---|---|---|
| JP | 2615206 | | 3/1997 | |
| JP | 2769066 | B2 * | 6/1998 | |
| JP | 2005-6939 | | 1/2005 | |
| JP | 2005006939 | A * | 1/2005 | A61G 7/05 |
| JP | 2005-218731 | | 8/2005 | |
| JP | 2005218731 | A * | 8/2005 | A61G 7/05 |
| JP | 2007-144007 | A | 6/2007 | |
| JP | 2008-125798 | | 6/2008 | |
| JP | 2008125798 | A * | 6/2008 | |
| JP | 2010043880 | A * | 2/2010 | |
| JP | 2010043881 | A * | 2/2010 | |
| WO | 91/06235 | A1 | 5/1991 | |

OTHER PUBLICATIONS

English language translation of International Preliminary Report on Patentability, mail date is Feb. 6, 2014.

Extended European Search Report in EP 12818289, dated Nov. 14, 2014.

Japanese Office Action in JP 2011-165309, with English language translation, dated Nov. 5, 2014.

Chinese Office Action in CN Application No. 201280005740.3 with partial English language translation, dated Dec. 3, 2014.

* cited by examiner

MATTRESS

INCORPORATED BY REFERENCE

The disclosure of Japanese Patent Application No. 2011-165309 filed on Jul. 28, 2011, including the specification, drawings and abstract are incorporated herein by reference in their entirety. This is a Continuation of International Application No. PCT/JP2012/004817 filed on Jul. 27, 2012.

BACKGROUND OF THE INVENTION

1. Field of the Invention

The present invention relates to a mattress used for a nursing care bed and the like.

2. Description of the Related Art

In a part of a bed for supporting the human body, a mattress with a cushion function has been used to improve the comfort of sleeping by elastically supporting the human body. This type of mattress is made of elastic materials such as urethane foam, for example.

When a user, who has disabled from himself or herself from turning over in bed, continues to use a conventional mattress for a long period of time, reaction forces against the body pressure (due to the body weight) are exerted continuously on the user's body part, thus posing a risk of developing bedsores caused by interrupted blood circulation and the like. Therefore, in order to prevent bedsores from developing, a movable mattress is proposed that can distribute the reaction forces substantially applied against the body pressure of the user, by means of changing the working points of the user's body pressure through the use of fluid pressure.

This movable mattress has its working portion of the body pressure (that supports the human body) composed of multiple cells arranged in rows and columns, wherein the cell heights are set to vary at a predetermined timing by means of drawing fluid such as outside air into a fluid chamber and exhausting it therefrom to adjust the inner pressure of the cells. This causes the cells that substantially support the user's body and those that do not to interchange with each other at a predetermined timing, thus preventing the user's body parts from being compressed for a long time due to the body pressure. Also, properly controlling the cell height at each location makes it possible to bring the surface of the mattress in line with the body contour and to promote distribution of body pressure, thus enabling to prevent concentration of loads from working on the bulging parts of the user's body (e.g. buttocks). Such mattress is described, for example, in Publication of Japanese Patent No. JP-B-2615206.

However, in a structure where fluid such as outside air is drawn and exhausted to and from the fluid chamber of each cell to adjust the cell height, the width dimension of each cell in the direction of alignment is naturally reduced as each cell is inflated by air supplied thereto. Therefore, as indicated in JP-B-2615206, a gap is formed between each pair of cells under an inflated condition thereof, which reduces the surface area that supports the user's body, posing a risk of not getting enough distribution of body pressure. Also, a larger gap between each pair of cells sometimes causes each cell to tilt more than necessary to fail to position itself at a desired height position. As a result, the surface configuration of the mattress cannot be aligned properly to follow the body contour, posing a risk of generating a local pressure to cause discomfort for the user.

SUMMARY OF THE INVENTION

The present invention has been developed in view of the background described above, and one object of the present invention is to provide a mattress with a novel structure capable of improving distribution properties of the body pressure, as well as capable of securely holding each cell at a given position.

A first mode of the present invention provides a mattress including: a plurality of cells aligned and disposed on a body pressure working surface of a substrate that supports a human body; and a pressure control member that changes a height of each cell by adjusting a pressure in a fluid chamber formed within the cell, the mattress being characterized in that the cells are configured such that as the each cell is inflated by fluid supplied to the fluid chamber within the cell, the height of the each cell increases and a width dimension of the each cell in a direction of alignment decreases, and that peripheral portions of adjacent cells in the direction of alignment are overlapped with each other prior to cell inflation.

With the mattress constructed according to the first mode, the peripheral portions of adjacent cells in the direction of alignment are overlapped with each other prior to the cell inflation. In other words, since the width dimension of each cell is set up in anticipation of any reduction in the width dimension due to the inflation of the cells, and the peripheral portions of adjacent cells are made to overlap with each other prior to the cell inflation, even when the cells inflate to raise their height, enough width dimension can be secured to prevent a sizable gap from forming between the adjacent cells. This allows the pressure receiving area of each cell to be set large enough and the gap between each pair of cells to be reduced or eliminated, thus improving the distribution properties of the body pressure.

Also, once the gap between each pair of cells with increased heights due to inflation is either reduced or eliminated, an upstanding condition of each cell can be maintained stably by having adjacent cells abut against and support each other in the direction of alignment. This makes it possible to prevent excessive tilt and collapse of each cell, thus providing each cell with a desired height position in a highly stable manner. Therefore, the attainment of a large pressure receiving area of each cell and highly accurate control of the cell height allow the surface configuration of the mattress to fully follow the body contour, thus providing the user with good sleeping comfort while preventing any local oppression to the body.

A second mode of the present invention is the mattress according to the first mode, wherein an overlap margin of the peripheral portions prior to the cell inflation is set within a range of 5 to 20% of the width dimension in the direction of alignment.

According to the second mode, since the peripheral portions of adjacent cells are made to overlap with each other at an overlap margin of 5 to 20% of the above width dimension prior to the inflation, the gap between each pair of cells after the inflation can surely be reduced or eliminated. Also, local bumps and hollows formed on the supporting surface of the mattress due to the overlapping of adjacent cells after the inflation as well as any interference with the tilting movement of the cells following the body contour can be prevented, thus achieving even more stable improvement to the distribution properties of the body pressure and the comfort of sleeping.

A third mode of the present invention provides the mattress according to the first or second mode, wherein a maximum width dimension of the cell in the direction of alignment in its maximum inflated condition is set within a range of 90 to 100% of a pitch dimension of the cells in the direction of alignment.

According to the third aspect, since the width dimension of each cell in its maximum inflated condition is set at 90 to 100% of the pitch or spacing dimension of the above cells in the direction of alignment, the gap between the cells under inflation can be made extremely small or eliminated. This allows the pressure receiving area of each cell to be set large enough more securely and the body pressure to be distributed more favorably. Since the width dimension of each cell under inflation is set at no more than the spacing distance thereof, overlapping of adjacent cells under the maximum inflation to form local bumps and hollows on the supporting surface of the mattress as well as any interference with the tilting movement of the cells following the body contour can be reliably prevented.

A fourth mode of the present invention provides the mattress according to any one of the first to third modes, wherein the cell is composed of a cell body configured by overlapping at least a pair of sheets with each other and adhering them along their peripheral edges in a fluid-tight way.

According to the fourth aspect, since each cell is composed of a cell body made by overlapping a pair of sheets with each other which are adhered along the peripheral edge in a fluid-tight way, each cell is arranged on the substrate being stuck on top of each other in a sheet formation after the discharge of the fluid to allow compact storing of the mattress. Also, when each cell is inflated by fluid supplied thereto, it undergoes deformation in the direction of moving away from each other decreasing its width dimension and increasing its height so that the inflating action of each cell can be performed quickly without having adjacent cells interfere with each other.

A fifth mode of the present invention provides the mattress according to the fourth mode, wherein the cell is composed of two cell bodies which are made in a two-tier structure, by bonding communication holes provided at centers of the overlapping surfaces of the respective cell bodies to each other in a fluid-tight way, and the cell bodies are made to tilt toward each other on both sides of a constricted portion formed in a middle of the cell in a height direction by means of the communication holes bonded together.

According to the fifth aspect, a constricted portion is formed in the middle of each cell in the height direction, which allows the cell bodies on both sides of the constricted portion to tilt and wobble centered around it. This causes each cell to support the surface of the mattress with a large pressure receiving area and the tilting movement in line with the body contour is made feasible in a more favorable way, thus achieving both distribution of body pressure and improved sleeping comfort more favorably.

According to the present invention, since the peripheral portions of adjacent cells are overlapped with each other in the direction of alignment prior to the cell inflation, formation of a sizable gap between adjacent cells after the inflation can be prevented. This allows the pressure receiving area of each cell to be set large enough to improve the distribution of body pressure. In addition, the reduction in the gap between cells makes it possible to prevent excessive tilt and collapse of each cell and allows the surface configuration of the mattress to fully follow the body contour, thus providing the user with good sleeping comfort.

BRIEF DESCRIPTION OF THE DRAWINGS

The foregoing and/or other objects, features and advantages of the invention will become more apparent from the following description of a preferred embodiment with reference to the accompanying drawings in which like reference numerals designate like elements and wherein.

DETAILED DESCRIPTION OF PREFERRED EMBODIMENTS

Figure 1:
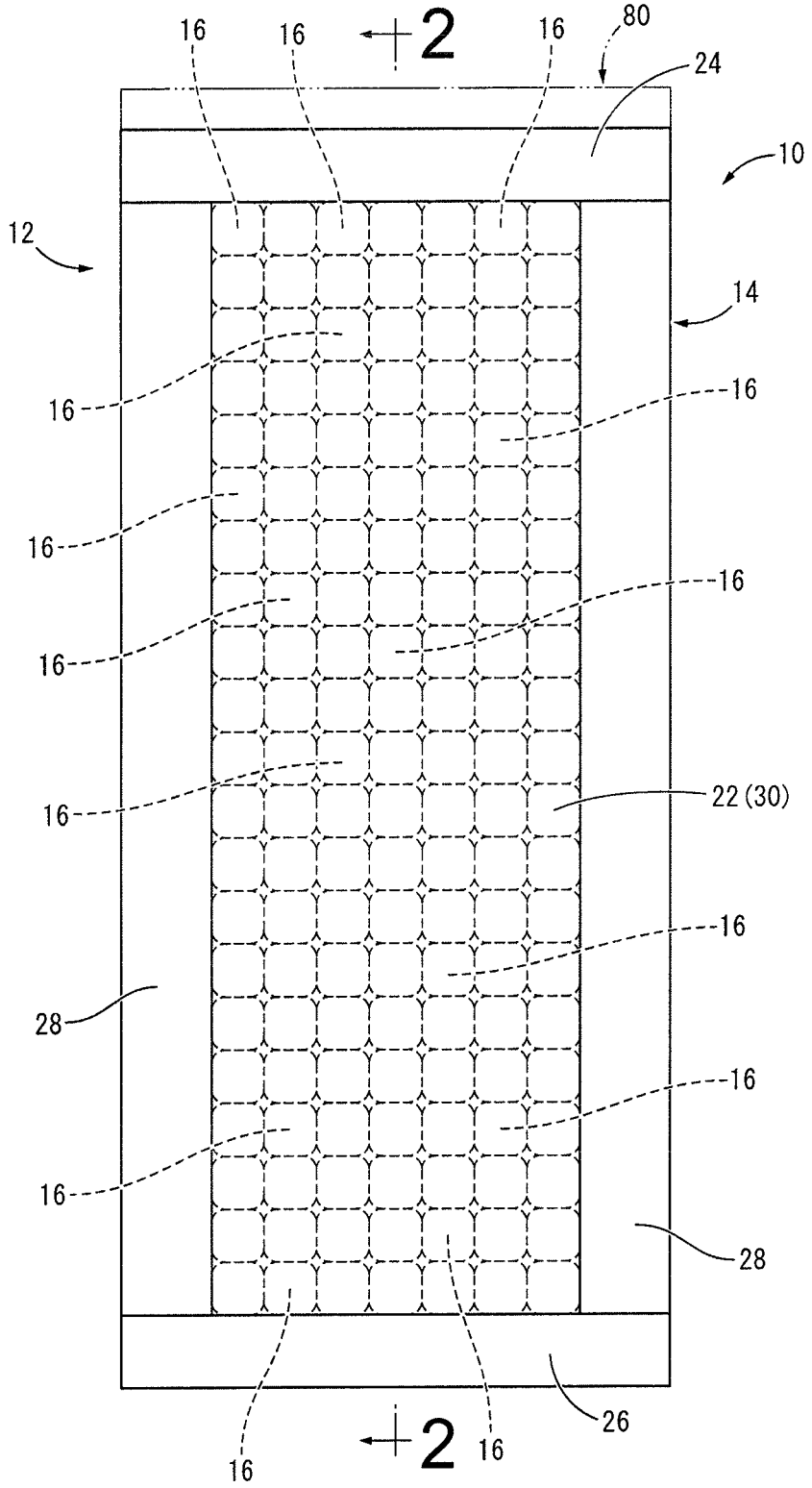
FIG. 1 is a plan view of a mattress as one embodiment of the present invention.
Figure 2:
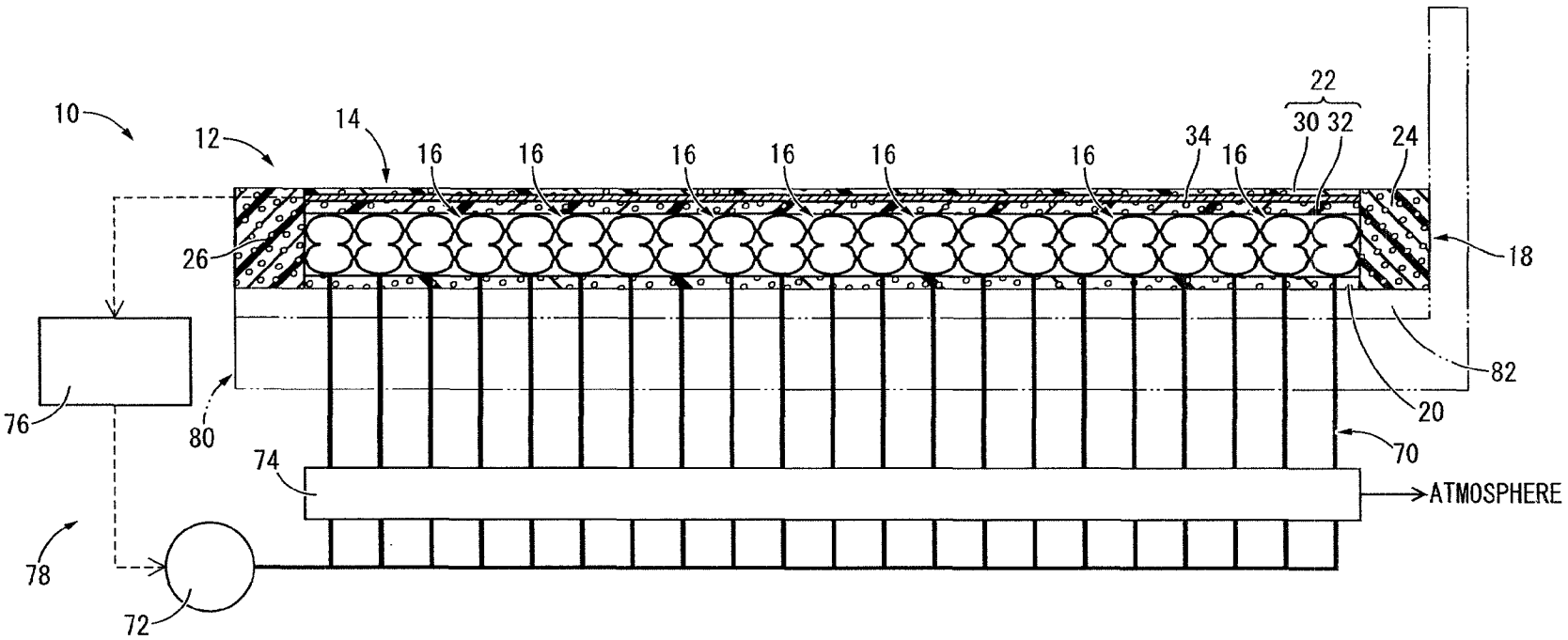
FIG. 2 is a cross-sectional view taken along line 2-2 of FIG. 1.

Embodiments of the present invention will be described in reference to the drawings as follows:

FIGS. 1 and 2 show a mattress 10 as one embodiment of the present invention. The mattress 10 comprises a mattress main body 12, which in turn comprises a box-like housing 14 and a plurality of cells 16 contained in the housing 14. In the following descriptions, the word "up and down direction" generally means an up and down direction in FIG. 2, which is a vertical direction therein.

More specifically, the housing 14 is formed entirely with an elastic material, and a bottom mat 20 is embedded as a substrate in the bottom opening of a framework 18, while a top mat 22 is embedded in the top opening of the framework 18 as a cushion.

The framework 18 is an elastic member formed entirely with porous urethane foam and structured with a head side block 24 and a foot side block 26 arranged parallel to each other that are connected by a pair of side blocks 28, 28 in a shape of a rectangular framework viewed in the up and down direction. The material making up the framework 18 is not particularly limited and is not limited to foamed materials but is preferably an elastic material such as urethane foam, considering the contact with the human body and the followability to deformation during head-up tilting of the bed, which will be described later.

The bottom mat 20 is a member in a shape of a rectangular plate made thinner than the framework 18 in the up and down direction, and is formed with porous urethane foam in the present embodiment. The bottom mat 20 also corresponds to the opening of the framework 18 in its shape viewed in the up and down direction, and is embedded in the bottom opening of the framework 18.

The top mat 22 is a member in a shape of a rectangular plate made thicker than the bottom mat 20, and is structured in two layers having a surface portion 30 as a first cushion layer and a back portion 32 as a second cushion layer, each formed with porous urethane foam. Also, the top mat 22 is made in an approximately the same shape as the bottom mat 20 viewed in the up and down direction, and is embedded in the upper opening of the framework 18. The surface portion 30 and the back portion 32 can be formed with the same material, but better sleeping comfort can be achieved by forming them with materials with different elastic moduli and so forth.

The top mat 22 is provided with a body pressure sensor 34. The body pressure sensor 34, made of a soft sheet, is arranged to be tucked between the surface portion 30 and the back portion 32 of the top mat 22, and these surface portion 30, body pressure sensor 34 and back portion 32 are stuck on top of each other. The specific structure of the body pressure sensor 34 is not particularly limited, but the capacitance type sensors in a sheet form as shown in U.S. Pat. No. 7,958,789 are preferably adopted. The body pressure sensor 34 is preferably thin and flexible in order not to adversely affect the sleeping comfort. However, as the body pressure sensor 34, it is possible to adopt a load cell and the like using a strain gauge or a magneto-striction body.

According to U.S. Pat. No. 7,958,789, the loads at 256 locations can be measured by detection units arranged in 16 columns and 16 rows, but in the present embodiment, the number of detection units of the body pressure sensor 34 is set according to the number of cells 16 described later, and the loads at 147 locations are considered to be measurable by the detector units arranged in 21 rows and 7 columns. The number of detection units of this body pressure sensor 34 is not necessarily limited to the same as that of the cells 16, but more detection units can be installed than the number of cells 16, for example, to detect body load with higher precision.

The housing 14 with such a structure contains a plurality of cells 16 arranged therein. As shown in FIGS. 3 to 6, each cell 16 is made like a bag or a balloon in a shape of a rectangle with its corners rounded in arc (rounded rectangle) in a planar view (in height direction), and is structured as a combination of an upper bag portion 36 and a lower bag portion 38 made in a two-tier structure, both as cell bodies. More specifically, the upper bag portion 36 is formed by welding or adhering to each other a pair of sheets composed of a top portion 40 in a shape of a rounded rectangle sheet and an upper intermediate portion 44 also in a shape of a rounded rectangle sheet whereas an opening 42 is formed at the center as a communication hole, along their peripheral edges 46. In addition, the lower bag portion 38 is formed by welding or adhering to each other a bottom portion 50 in a shape of a rounded rectangle sheet with a port 48 attached at the center and a lower intermediate portion 54 in a shape of a rounded rectangle sheet with an opening 52 formed at the center as a communication hole along their peripheral edges 56. Then, each cell 16 is formed by welding or being bonded to each other the upper intermediate portion 44 and the lower intermediate portion 54 along the openings 42, 52, and the upper bag portion 36 and the lower bag portion 38 are made to tilt and wobble against each other on both sides of a constricted portion 58 formed in the middle of the cell 16 in the height direction. In the present embodiment, one side of the overlapping surfaces of the cell body is configured by the upper intermediate portion 44, while the other side thereof is configured by the lower intermediate portion 54.

Materials representative of the sheet material that makes up the above cells 16 include thermoplastic elastomer, and more specifically polyurethane elastomer as well as olefin, styrene and polyamide elastomers. In the present embodiment, the longitudinal and lateral dimensions of the cells 16 are almost equal, but either one can be made longer than the other. Also in the present embodiment, the size and shape of the upper bag portion 36 and the lower bag portion 38 are made almost equal, but they can be differentiated.

Within the cell 16 with such a structure is formed a fluid chamber 60. The fluid chamber 60 is formed by communicating each other the interiors of the upper bag portion 36 and the lower bag portion 38 through a communication portion 62 using the openings 42, 52 of the bag portions 36, 38, respectively. The fluid chamber 60 is closed almost tightly from the outside and communicated thereto through the port 48 in a cylindrical shape penetrated through the bottom portion of the cell 16. And, the cell 16 can be switched between the inflated condition shown in FIGS. 3 and 4, the contracted condition shown in FIGS. 5 and 6, or any other intermediate conditions in between by having fluid such as air supplied and exhausted to and from the fluid chamber 60 through the port 48.

Figure 3:
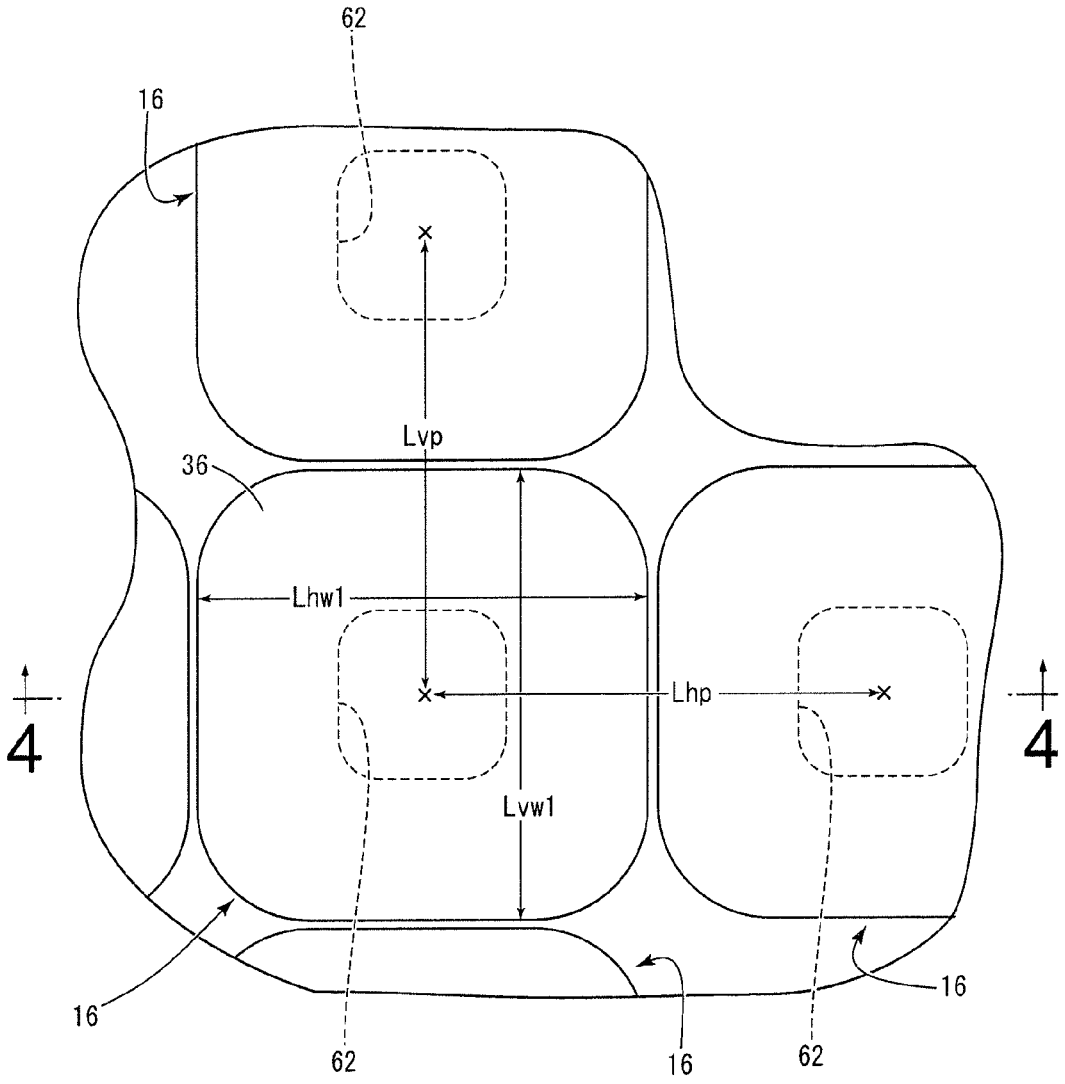
FIG. 3 is a plan view of cells composing the mattress shown in FIG. 1 in its maximum inflated condition.
Figure 4:
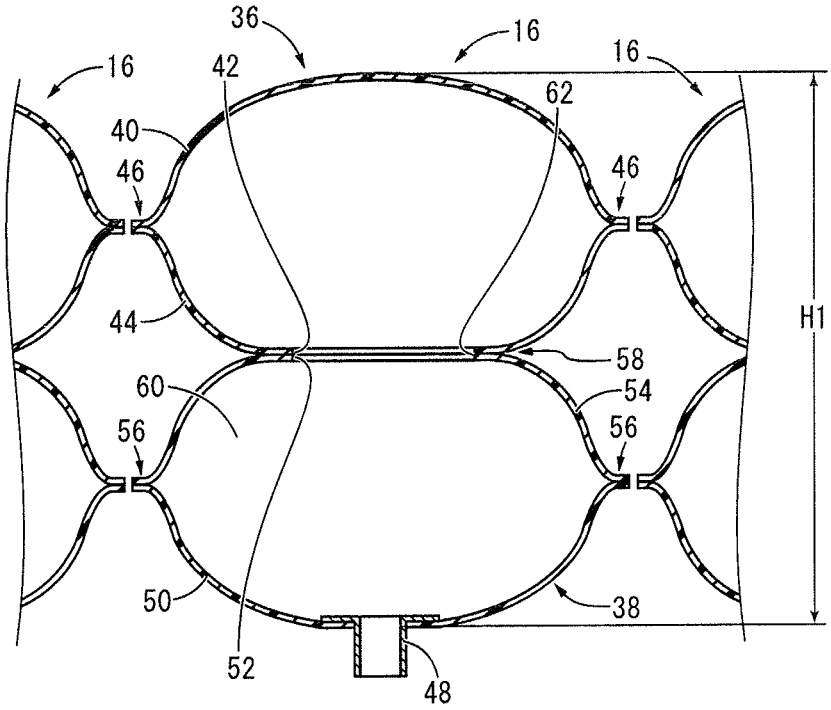
FIG. 4 is a cross sectional view taken along line 4-4 of FIG. 3.
Figure 5:
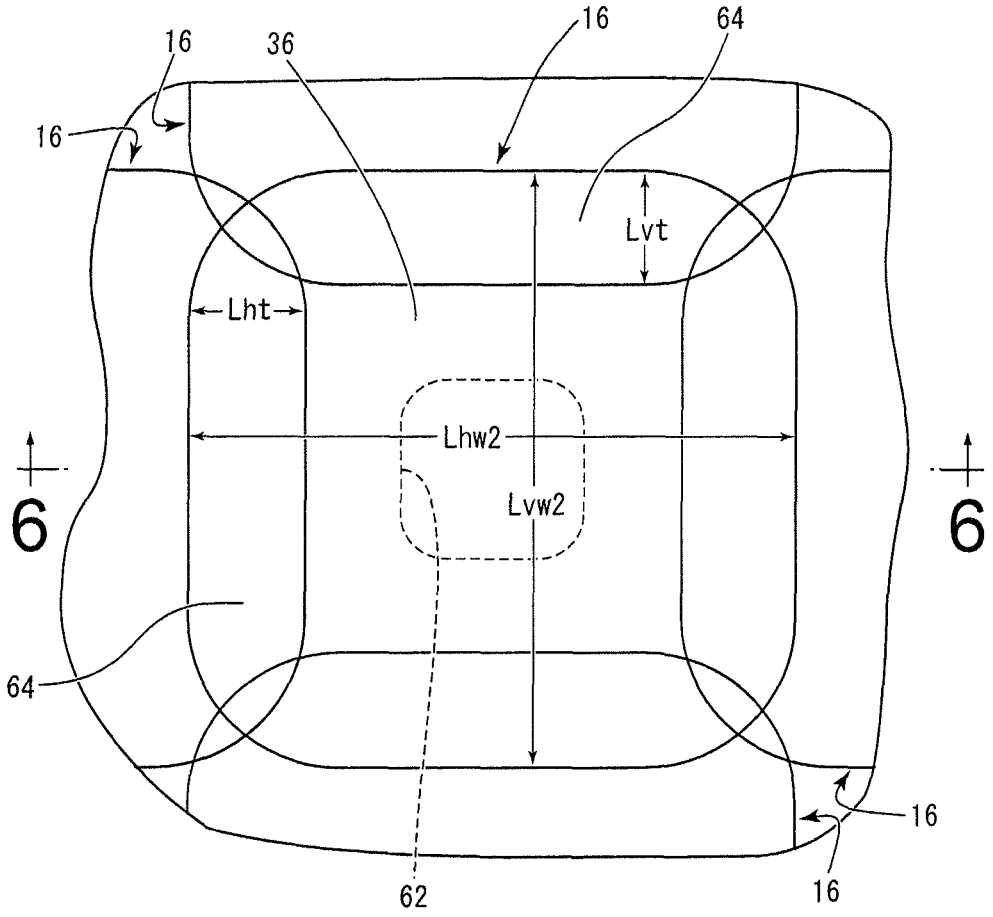
FIG. 5 is a plan view of the cells composing the mattress shown in FIG. 1 in its maximum contracted condition.
Figure 6:
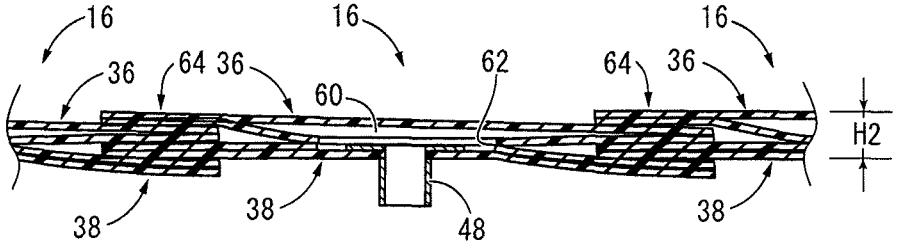
FIG. 6 is a cross sectional view taken along line 6-6 of FIG. 5.

In other words, the cell 16 is inflated as fluid is sent to the fluid chamber 60 of the cell 16 in its maximum contracted condition before being inflated as shown in FIGS. 5 and 6 to reach the maximum inflated condition shown in FIGS. 3 and 4. The cell 16 in its maximum inflated condition has a larger height at the center than the cell 16 in its contracted condition (H1>H2) and a smaller lateral dimension at the peripheral edge 46, which is the width of cell 16 in the direction of alignment (left-right and up-down directions in FIGS. 3 and 5) (Lhw1<Lhw2, Lvw1<Lvw2). In other words, the cell in its inflated condition has a smaller projected area in the height direction than that of the cell 16 in its contracted condition. And, the inner pressure of the cell 16 is not just set in the two conditions alone, that is, the maximum inflated condition shown in FIG. 4 and the maximum contracted condition shown in FIG. 6, but also set continuously or in steps between the maximum inflated condition and the maximum contracted condition. The fluid supplied and exhausted to and from the cell 16 is not limited to air but also includes liquids such as water.

As evident from FIGS. 3 and 4, the cell 16 in the maximum inflated condition is aligned and disposed side by side with the adjacent cells 16 with almost no space in between. The cell 16 in the maximum inflated condition is formed in such a way that the maximum widths Lhw1, Lvw1 in the direction of alignment (left-right and up-down directions in FIG. 3) are nearly equal or slightly less than the spacing dimensions Lhp, Lvp, respectively, of the cell 16. More specifically, the maximum widths Lhw1, Lvw1 of the cell 16 in the maximum inflated condition in the direction of alignment are preferably set within a range of 90 to 100% of the spacing dimensions Lhp, Lvp, respectively, of the cell 16 in the same direction. If the maximum widths Lhw1, Lvw1 are less than 90% of the above spacing dimensions Lhp, Lvp, the spacing between the adjacent cells 16 can be too wide, posing a risk of not being able to keep the proper distribution of body pressure. Also, too wide a spacing between cells 16 would have a risk of producing excessive tilt and collapse of each cell 16, making it difficult to keep it in an upstanding condition and making the supporting surface in a crooked shape. On the other hand, if the maximum widths Lhw1, Lvw1 go beyond 100% of the spacing dimensions Lhp, Lvp, the adjacent cells 16 in an inflated condition get overlapped with each other to prevent them from tilting and wobbling, posing a risk of not being able to form a supporting surface in line with the body contour. In the present embodiment, the maximum widths Lhw1, Lvw1 of the cells 16 are made nearly equal to the spacing dimensions Lhp, Lvp, respectively, of the cells 16 in the direction of alignment.

Also, as evident from FIGS. 5 and 6, since the longitudinal and lateral dimensions (maximum width dimensions) Lhw2, Lvw2 under the maximum contracted condition are larger than those under the maximum inflated condition, overlap margins 64 are created along the peripheral portions of the adjacent cells 16 under the maximum contracted condition. More specifically, it is preferable that the lengths of Lht, Lvt of the overlap margins 64 between the adjacent cells 16 under the maximum contracted condition in the direction of alignment (left-right and up-down directions in FIG. 5) be set within a range of 5 to 20% of the maximum widths Lhw2, Lvw2 of the cells 16 in the direction of alignment. In other words, if either of the ratios of the overlap margins 64 (Lht/

Lhw2, Lvt/Lvw2) is less than 5%, the spacing between the adjacent cells 16 in an inflated condition gets too wide, which fails to provide the proper distribution of body pressure and to control excessive tilt and collapse of each cell 16, posing a risk of not being able to keep a stable upstanding condition of each cell. On the other hand, if either of the ratios of the overlap margins 64 (Lht/Lhw2, Lvt/Lvw2) goes beyond 20%, the adjacent cells 16 in an inflated condition overlap with each other to prevent them from tilting and wobbling, posing a risk of not being able to form a supporting surface in line with the body contour. Therefore, more preferably, either of the ratios of the overlap margins 64 (Lht/Lhw2, Lvt/Lvw2) is set within a range of 10-20%, and it is set at approximately 20% in the present embodiment. The order of overlapping in the overlap margin 64 is just an example and is not limited to the above example.

Figure 7:
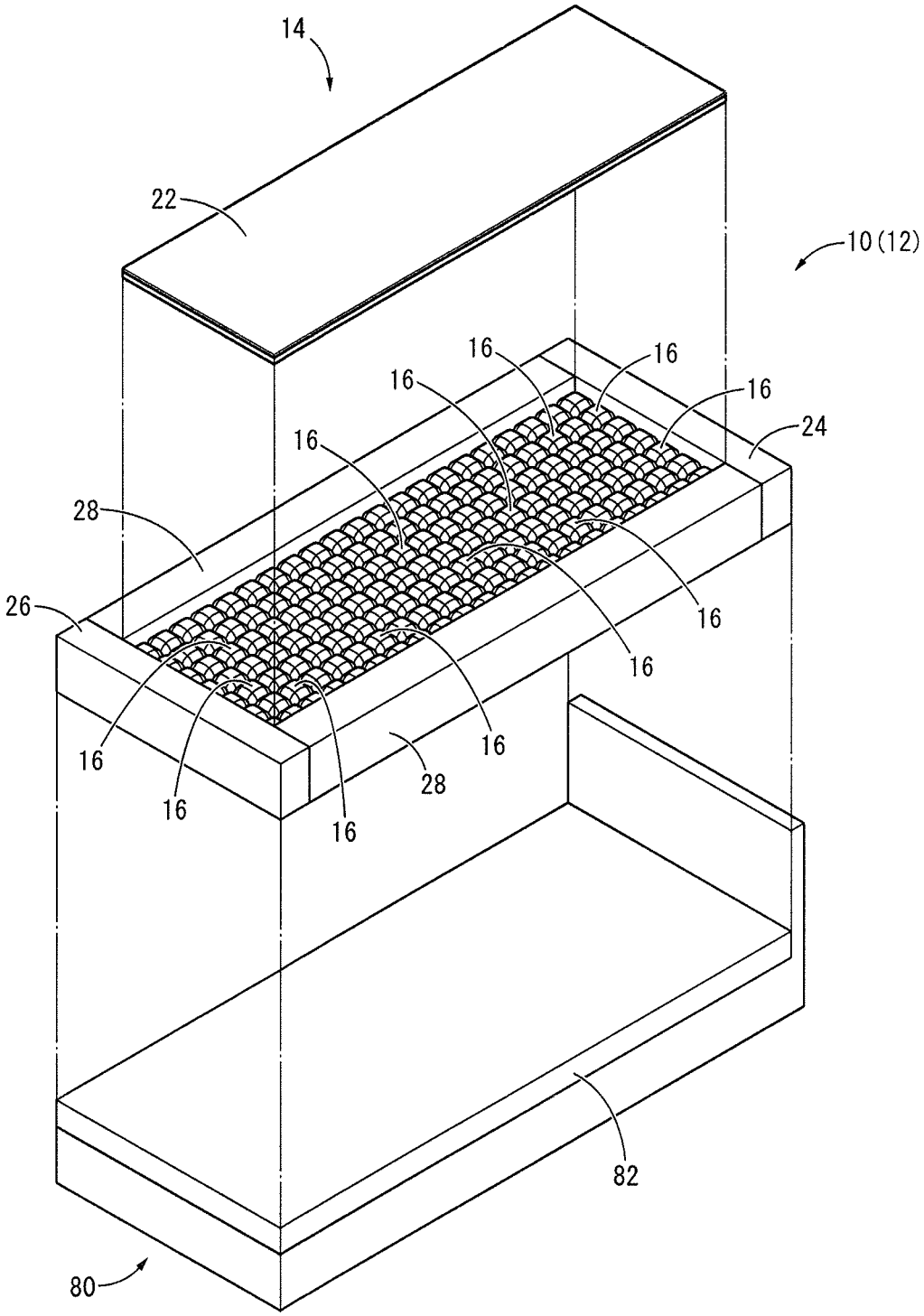
FIG. 7 is an exploded perspective view of the mattress shown in FIG. 1 and a bed that supports it.
Figure 8:
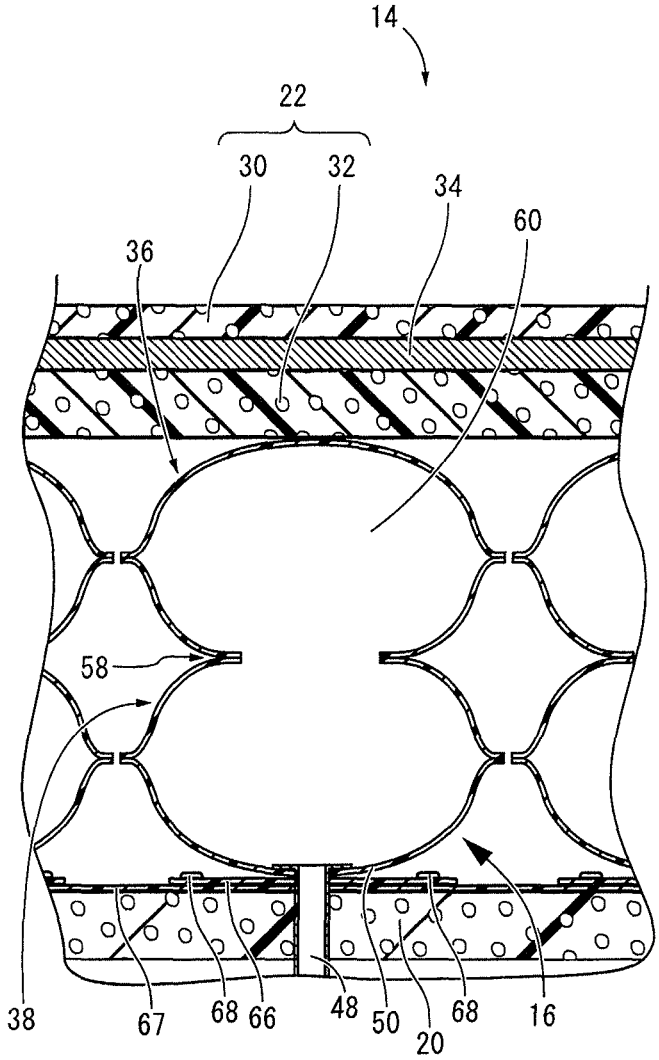
FIG. 8 is an enlarged view of the cross-section shown in FIG. 2.

The cell 16 with the structure described above is stored in plurality in the housing 14 as shown in FIG. 7. In other words, a plurality of cells 16 are aligned and disposed on the inner peripheral side of the framework 18 mostly side by side on the upper face of the bottom mat 20, to which the bottom face of each cell 16 is fixed at the center (around the periphery of the port 48) so that each cell 16 is supported by the bottom mat 20 in a tiltable way relative thereto. More specifically, as shown in FIG. 8, a mounting sheet 66 is arranged under the plurality of cells 16. The mounting sheet 66 is in a shape of a rounded rectangle slightly smaller than the bottom portion 50 of the lower bag portion 38. Each mounting sheet 66 is provided with a through hole at a location corresponding to the port 48 of each cell 16 where the port 48 is arranged penetrating through each cell 16, and each mounting sheet 66 and each cell 16 are integrally connected by having each port 48 welded to the periphery of each through hole all the way around. Also at each rectangle corner of the mounting sheet 66, one of the mounting members 68, such as a snap made of a pair of male and female members, is installed. The others of the mounting members 68 are arranged at a proper location on each of the fixing sheets 67 generally scattered across the entire upper face of the bottom mat 20, and the mounting sheet 66 is installed fixed to the fixing sheet 67 via the mounting member 68. Here, the fixing sheet 67 is fixed to the bottom mat 20 at a proper location as needed. Then, the port 48 of each cell 16 is arranged penetrating the fixing sheet 67 and the bottom mat 20. Furthermore, on the top face of the cell 16, the top mat 22 is overlapped with no adhesive and fitted onto the upper opening of the framework 18. In the present embodiment, the 147 cells 16 are arranged in 21 rows and 7 columns as shown in FIG. 1.

Each port 48 is connected to a supply and drainage channel 70 outside the housing 14 so that the fluid chamber 60 of the cell 16 can be communicated selectively either with a pump 72 or the atmosphere via the supply and drainage channel 70. The connection of the fluid chamber 60 to the pump 72 and the opening to the atmosphere can be switched between the two by a valve means 74 such as a three-way valve installed along the supply and drainage channel 70. Also, the fluid chamber 60 of each cell 16 is substantially independent from each other so that air does not flow between the cells 16. Such independence of the fluid chamber 60 is achieved, for example, by giving independence to the supply and drainage channel 70 per each cell 16.

Then, the pressure in the fluid chamber 60 is heightened by the connection of the fluid chamber 60 to the pump 72 that supplies air to the fluid chamber 60 to bring the cell 16 to an inflated condition as shown in FIGS. 3 and 4. Meanwhile, the pressure in the fluid chamber 60 is lowered to bring the cell 16 to a contracted condition shown in FIGS. 5 and 6 by means of opening up the fluid chamber 60 to release the air therein to the atmosphere. As evident from FIGS. 4 and 6, this allows the height dimension of the cell 16 in the up and down direction to be changed by controlling the pressure in the fluid chamber 60. Other than the above means using the valve means 74, the means for controlling the pressure in the fluid chamber 60 can be obtained by connecting the fluid chamber 60 to the pump 72 all the time and by controlling the operation of the pump 72 through the adoption of a pump, as the pump 72, that is switchable between air intake and air exhaust operations.

In addition, the pump 72 and the valve means 74 are controlled by a control means 76. The control means 76 controls the flow rate of the pump 72 and switching of the valve means 74 and the like by generating control signals based on detection signals inputted from the body pressure sensor 34 of the top mat 22 and outputting them to the pump 72 and the valve means 74. In the present embodiment, since the air pressure of the plurality of cells 16 can be set differently, the pump 72 capable of differentiating the flow rate for each cell 16 can be adopted, or the air pressure can be set individually by adjusting the switching timing of the valve means 74 for each cell 16. As evident from the above, a pressure control member 78 for varying the setting of the height of the cell 16 comprises the body pressure sensor 34, supply and drainage channel 70, pump 72, valve means 74 and control means 76.

As shown in FIG. 7, the mattress 10 with such structure has the mattress main body 12 overlapped on a body support portion 82 of a bed 80. Then, when the user lies down on the mattress 10, he is supported by the body support portion 82 of the bed 80 as his body pressure is applied to the top mat 22, the plurality of cells 16 and the bottom mat 20. Also, the supply and drainage channel 70, pump 72, valve means 74 and control means 76 are arranged in the storage space provided within, or below the body support portion 82 of the bed 80 and so forth. Since the body weight (body pressure) based on the gravity acting on the user works downward, each of the upper faces of the top mat 22, cell 16, bottom mat 20 and body support portion 82 is called a body pressure working surface.

The mattress 10 of the present embodiment with such structure is capable of restricting the reaction force against the body pressure exerted by the mattress main body 12 on the user from increasing locally when the user lies down on the top mat 22.

More specifically, air is first sent from the pump 72 to the fluid chamber 60 of each cell 16 before the user lies down on the top mat 22 so as to maximize the height of the cell 16. This prevents the cell 16 from bottoming when the user lies down thereon, thus supporting the user with enough shock absorbing ability.

Also, as the body weight of the user who lies down on the top mat 22 is applied to the body pressure sensor 34, the body pressure sensor 34 detects the body pressure distribution based on the contour of the user's body surface, results of which are outputted to the control means 76 as detection signals. The body pressure sensor 34 is made capable of individually detecting the magnitude of the (body) pressure acting on each cell 16, and in the present embodiment, the body pressure sensor 34 is made to receive detection signals from each of 147 of the cells 16.

Also, the control means 76 outputs control signals to the pump 72 and the valve means 74 based on the detection signals sent from the body pressure sensor 34. Then the pressure in the fluid chamber 60 of each cell 16 is adjusted to change the height setting of the cell 16 by controlling the flow rate of the pump 72 and by selectively connecting the fluid chamber 60 either to the pump 72 or to the atmosphere by use of the valve means 74.

Then, in each cell 16 subjected to large body pressure, the pressure in the fluid chamber 60 is adjusted low to decrease the height of the cell 16, while in each cell 16 subjected to small body pressure, the pressure in the fluid chamber 60 is adjusted high to increase the height of the cell 16. This allows the height of the cell 16 to be adjusted to follow the contour of the body surface and prevents the body pressure from acting locally, resulting in proper distribution of body pressure.

Here, the cell 16 is formed in such a way that the overlap margin 64 is created along the periphery between the adjacent cells 16 in their maximum contracted conditions, and the lengths Lht, Lvt of the overlap margins 64 are made at 5 to 20% (approximately 20% in the present embodiment) of the widths Lhw2, Lvw2 of the cells 16 in the direction of alignment, as described above. Therefore, the gap between each pair of cells 16 is either reduced or eliminated in each cell 16 under its inflated condition, thus enabling to increase the pressure receiving area of each cell 16 to enhance the distribution of body pressure. Also, by having adjacent cells 16 abut against and support each other in the direction of alignment, the upstanding condition, that is, the height position of each cell 16 can be maintained in a stable way. Therefore, it is made possible to control the large pressure receiving area and the height of each cell 16 and to prevent any local oppression to the body while letting the surface configuration of the top mat 22 fully follow the body contour, thus providing the user with the sleeping comfort.

Also, the maximum widths Lhw1, Lvw1 of the cell 16 in the directions of alignment (left-right and up-down directions in FIG. 3) under the maximum inflated condition are made equal to 90 to 100% (approximately 100% in the present embodiment) of the spacing dimension Lhp, Lvp of the cell 16 in the direction of alignment. Therefore, the gap between each pair of cells 16 is surely reduced or eliminated in each cell 16 under its inflated condition to enable the comfort of sleeping, as described above, by achieving a large enough pressure receiving area and controls with high accuracy over the height position of the cell 16. Especially, generation of the gap between each pair of adjacent cells 16 can be prevented more favorably by making each cell 16 in a rounded rectangle in a planar view, thus enabling to secure a large enough supporting area in each cell 16.

Additionally, in the present embodiment, each cell 16 is configured in a two-tier structure where the upper bag portion 36 and the lower bag portion 38 are made to tilt and wobble on both sides of the constricted portion 58 formed in the middle in the height direction. Therefore, the upper face (body pressure working surface) of each cell 16 tilts following the deformation (displacement) of the top mat 22 by having each cell 16 tilt and wobble at the constricted portion 58. This allows the supporting surface in a shape corresponding to the contour of the top mat 22 to be configured by the upper face of a plurality of cells 16, and further allows the surface of the mattress 10 to be deformed in a way highly followable to the body contour. Therefore, the upper face of the cell 16 is abutted against the user's body surface in a wider area to achieve distribution of body pressure in a more favorable way. This prevents any strong local oppression to the user's body and restricts the formation of bedsores.

Also, each cell 16 is composed of cell bodies configured by overlapping a pair of sheets in a rounded rectangle shape with each other and adhering them along the peripheral edge in a fluid-tight way. Thus, by configuring each cell 16 by overlapping planar members on top of each other, the cell 16 in its contracted condition can be made very compact as shown in FIG. 6, which provides an excellent operability as well as production efficiencies and cost reduction of the cell 16. Also, since the cell 16 configured with overlapped sheets exhibits a width contraction following the increased height under an inflated condition in the direction moving away from each other between the adjacent cells 16, the inflating action of each cell 16 can take place promptly without interference with each other between the adjacent cells 16.

Embodiments of the present invention have been described in detail above, but the present invention is not limited by those specific descriptions. For example, the shape of the cell 16 in a planar view is not limited to the rounded rectangle like that in the above embodiment, but circles, various polygons with or without rounded corners, irregular shapes or any other shape can be adopted.

Figure 9:
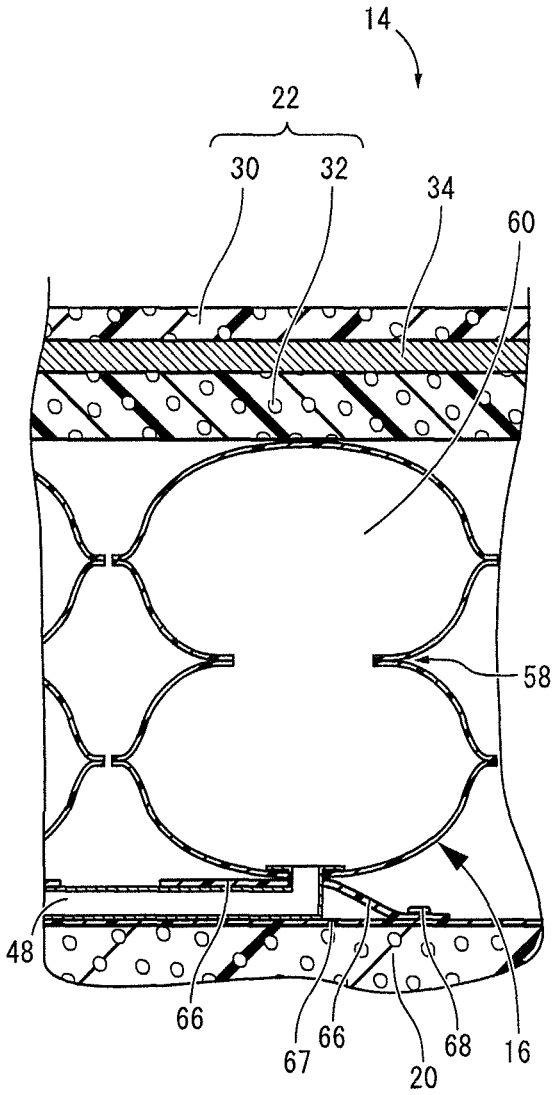
FIG. 9 is an enlarged view of a cross-section of another embodiment of the present invention.

Also, in the above embodiment, the port 48 of each cell 16 was arranged to extend out penetrating the fixing sheet 67 and the bottom mat 20, but the port 48 of each cell 16 can be arranged to extend out toward one side of the mattress main body 12 on the fixing sheet 67 without penetrating the bottom mat 20 as shown in FIG. 9. This way, a plurality of valve means 74 to be connected to the fluid chamber 60 of each cell 16 and the control means 76 thereof can be collectively arranged on the side of the mattress main body 12, thus enhancing its maintainability. The port 48 of each cell 16 and the piping extending therefrom can extend out toward the side of the mattress penetrating through the area between the mounting members 68 provided on four corners of the mounting sheet 66. This allows the mounting sheet 66 to function as a positioning retention means for the port 48 and the piping extending therefrom.

Also, in the above embodiment, each cell 16 was set to its initial state with all the cell heights maximized before the user lies down on the mattress main body 12, but the cell 16 can be set initially after the user lies down thereon by means of adjusting the internal pressure with the user lying on bed, or the cell 16 can be set to its initial state after the user changes his body position (after turning over etc.). The initial setting of the cell 16 is not necessarily limited to maximizing each cell height, but can also be adjusted to any prescribed height per each cell 16.

Also, the cells 16 do not have to be composed of cell bodies made by overlapping a pair of sheets with each other and adhering them at the peripheral edge in a fluid-tight way, but a bag-like cell body composed of a single sheet or a bag-like cell body made of three or more sheets adhered to each other can be adopted as long as the widths in the direction of alignment decrease following the inflation of the cells 16. Furthermore, the shape of the cell 16 in a planar view does not have to be approximately similar to that of the constricted portion 58 (communication portion 62), but for example, the constricted portion 58 (communication portion 62) in a circular shape can be provided to the cell 16 in a shape of a rounded rectangle.

In addition, in the present embodiment, the cell 16 is made in a two-tier structure having the upper bag portion 36 and the lower bag portion 38 with only one constricted portion 58, but the cell 16 can be in a three or more tiered structure, in which case two or more constricted portions 58 can be formed.

What is claimed is:

1. A mattress comprising:

a plurality of cells aligned and disposed on a body pressure working surface of a substrate that supports a human body; and a pressure control member that changes a height of each cell by adjusting a pressure in a fluid chamber formed within the cell, wherein the cells are configured such that as each cell is inflated by fluid supplied to the fluid chamber within the cell, the height of each cell increases and a width dimension of each cell in a direction of alignment decreases, and that peripheral portions of adjacent cells in the direction of alignment are overlapped with each other prior to cell inflation, wherein a maximum width dimension of the cell in the direction of alignment in a maximum inflated condition of the cell is set within a range of 90 to 100% of a pitch dimension of the cells in the direction of alignment, the pitch dimension being defined by a spacing between centers of adjacent cells in the direction of alignment, wherein a port penetrates through a bottom portion of each cell so that the fluid is supplied to and exhausted from the fluid chamber of each cell through the port, wherein a mounting sheet is arranged under the bottom portion of each cell, the mounting sheet having a through hole that the port is arranged to penetrate through, and the mounting sheet being integrally connected to each cell with a periphery of the through hole being welded to the port, and wherein the mounting sheet is provided with a mounting member that is detachably mounted on a mounted member provided on a side of the substrate so that each cell is detachably fixed on the substrate.

2. The mattress according to claim 1, wherein an overlap margin of the peripheral portions prior to the cell inflation is set within a range of 5 to 20% of the width dimension in the direction of alignment.

3. The mattress according to claim 1, wherein the cell is composed of a cell body configured by overlapping at least a pair of sheets with each other and adhering them along their peripheral edges in a fluid-tight way.

4. The mattress according to claim 3, wherein the cell is composed of two cell bodies which are made in a two-tier structure, and peripheral edges of the cell bodies, surrounding communication holes provided at centers of the overlapping surfaces of the respective cell bodies, are bonded together in a fluid-tight manner, and wherein the cell bodies are made to tilt toward each other on both sides of a constricted portion formed in a middle of the cell in a height direction via the peripheral edges of the cell bodies being bonded together.

5. A mattress comprising:

a plurality of cells aligned and disposed on a body pressure working surface of a substrate that supports a human body; and a pressure control member that changes a height of each cell by adjusting a pressure in a fluid chamber formed within the cell, wherein the cells are configured such that as each cell is inflated by fluid supplied to the fluid chamber within the cell, the height of each cell increases and a width dimension of each cell in a direction of alignment decreases, and that peripheral portions of adjacent cells in the direction of alignment are overlapped with each other prior to cell inflation, and each cell having a rounded rectangular shape in a planar view, wherein a port penetrates through a bottom portion of each cell so that the fluid is supplied to and exhausted from the fluid chamber of each cell through the port, wherein a mounting sheet is arranged under the bottom portion of each cell, the mounting sheet having a through hole that the port is arranged to penetrate through, and the mounting sheet being integrally connected to each cell with a periphery of the through hole being welded to the port, and wherein the mounting sheet is provided with a mounting member that is detachably mounted on a mounted member provided on a side of the substrate so that each cell is detachably fixed on the substrate.

6. The mattress according to claim 1, wherein the cell is fixed at a bottom face thereof to the substrate and a top face of the cell is not fixed to the substrate, and the cell is supported by the substrate such that the top face of the cell is movable in a tilted way relative to the substrate.

7. The mattress according to claim 5, wherein the cell is fixed at a bottom face thereof to the substrate and a top face of the cell is not fixed to the substrate, and the cell is supported by the substrate such that the top face of the cell is movable in a tilted way relative to the substrate.

* * * * *